US008337154B2

(12) United States Patent
Decker et al.

(10) Patent No.: US 8,337,154 B2
(45) Date of Patent: Dec. 25, 2012

(54) HIGH EFFICIENCY COOLING FAN

(75) Inventors: John Decker, Cypress, TX (US); Chellappa Balan, Niskayuna, NY (US)

(73) Assignee: Xcelaero Corporation, San Luis Obispo, CA (US)

( * ) Notice: Subject to any disclaimer, the term of this patent is extended or adjusted under 35 U.S.C. 154(b) by 1239 days.

(21) Appl. No.: 12/074,345

(22) Filed: Mar. 3, 2008

(65) Prior Publication Data

US 2008/0226454 A1 Sep. 18, 2008

Related U.S. Application Data

(60) Provisional application No. 60/905,248, filed on Mar. 5, 2007.

(51) Int. Cl.

| | |
|---|---|
| ***F04D 29/44*** | (2006.01) |
| ***F04D 29/54*** | (2006.01) |
| ***F03B 1/00*** | (2006.01) |
| ***F03D 5/00*** | (2006.01) |
| ***B63H 1/26*** | (2006.01) |
| ***B64C 11/16*** | (2006.01) |

(52) U.S. Cl. ..... 415/191; 415/208.2; 415/211.2; 416/223 R; 416/238; 416/DIG. 2; 416/DIG. 5

(58) Field of Classification Search ..... 415/211.2, 415/191, 208.1, 208.2; 416/238, 241 R, 416/223 R, DIG. 5, DIG. 2

See application file for complete search history.

(56) References Cited

U.S. PATENT DOCUMENTS

| | | | | |
|---|---|---|---|---|
| 4,408,958 | A * | 10/1983 | Schacle | 416/237 |
| 4,981,414 | A | 1/1991 | Sheets | |
| 5,088,892 | A * | 2/1992 | Weingold et al. | 415/193 |
| 5,152,661 | A * | 10/1992 | Sheets | 415/84 |
| 5,577,888 | A * | 11/1996 | Capdevila et al. | 415/210.1 |
| 6,116,856 | A | 9/2000 | Karadgy et al. | |
| 6,129,528 | A | 10/2000 | Bradbury et al. | |
| 6,386,830 | B1 * | 5/2002 | Slipper et al. | 415/211.2 |
| 6,508,630 | B2 | 1/2003 | Liu et al. | |
| 6,709,239 | B2 * | 3/2004 | Chandraker | 416/238 |
| 6,722,849 | B1 | 4/2004 | Lievens et al. | |
| 6,755,615 | B2 | 6/2004 | Chapman | |
| 7,168,918 | B2 | 1/2007 | Balan et al. | |
| 7,175,393 | B2 * | 2/2007 | Chandraker | 416/223 A |
| 7,374,403 | B2 | 5/2008 | Decker et al. | |
| 2003/0012645 | A1 | 1/2003 | Donnaruma et al. | |
| 2005/0089403 | A1 * | 4/2005 | Ito et al. | 415/191 |
| 2005/0184605 | A1 | 8/2005 | Vinson et al. | |
| 2005/0186096 | A1 * | 8/2005 | Vinson et al. | 417/423.1 |
| 2007/0036647 | A1 * | 2/2007 | Abdelwahab et al. | 415/211.2 |
| 2008/0131272 | A1 * | 6/2008 | Wood et al. | 415/199.5 |
| 2008/0148564 | A1 * | 6/2008 | Burton et al. | 29/888.02 |
| 2009/0317227 | A1 * | 12/2009 | Grover et al. | 415/1 |

* cited by examiner

*Primary Examiner* — Edward Look
*Assistant Examiner* — Su Htay
(74) *Attorney, Agent, or Firm* — Henry C. Query, Jr.

(57) ABSTRACT

A cooling fan includes an impeller which comprises a plurality of radially extending blades, each of which includes a blade hub, a blade tip and a blade midspan approximately midway between the hub and the tip. In addition, each blade includes a camber of between about 60° and 90° at the blade hub, between about 15° and 40° at the blade midspan and between about 15° and 40° at the blade tip.

38 Claims, 11 Drawing Sheets

(Design A)

(Design B)

(Design C)

(Design D)

(Design A)

(Design B)

(Design C)

(Design D)

HIGH EFFICIENCY COOLING FAN

This application is based on and claims the benefit of U.S. Provisional Patent Application No. 60/905,248, which was filed on Mar. 5, 2007.

BACKGROUND OF THE INVENTION

This present invention relates to a high efficiency, high work coefficient fan which can be used, for example, in electronics cooling applications.

Many prior art cooling fans include a motor-driven impeller which propels a stream of air through a fan housing. These fans may also comprise an outlet guide vane assembly which is positioned downstream of the impeller to both de-swirl and increase the static pressure of the air, and a diffuser section which is located downstream of the outlet guide vane assembly to decelerate and thereby further increase the static pressure of the air.

The impeller and the outlet guide vane assembly each include a plurality of radially extending blades or vanes. The shape of each blade or vane can be defined by the values of camber, chord and stagger for each of a plurality of radially spaced airfoil segments in the blade or vane, as well as the degrees of lean and bow for each of the leading and trailing edges of the blade or vane. In addition, the overall configuration of the impeller and the outlet guide vane assembly can be defined in terms of the solidity and aspect ratio of the blades or vanes as a whole.

In the inventors' experience, prior art cooling fans typically have total-to-static efficiencies of less than 60%. Low fan efficiencies require the use of larger and heavier motors which must operate at higher speeds. These motors usually require increased power to operate, generate more noise and have reduced life spans. Fan inefficiencies may result from virtually any choice made during the design process, from architecture selection through the detailed design of the flowpath surfaces, the impeller blades and the guide vanes.

Prior art cooling fans use bow and lean in the impeller blades and guide vanes in order to achieve certain desired performance characteristics. In prior art cooling fans in which the flow near the midspan of the blades or vanes is weak, however, increasing the bow and lean angles may be detrimental since it would increase the aerodynamic loading near the midspan. Because the flow near the midspan is already weak, additional loading from increased bow would lead to increased flow separation and poorer performance. This is especially true for smaller fans with lower aspect ratio impeller blades and guide vanes.

SUMMARY OF THE INVENTION

In accordance with one embodiment of the present invention, a cooling fan comprises an impeller which includes a plurality of radially extending blades, each of which includes a blade hub, a blade tip and a blade midspan approximately midway between the hub and the tip. In addition, each blade comprises a camber of between about 60° and 90° at the blade hub, between about 15° and 40° at the blade midspan and between about 15° and 40° at the blade tip.

In accordance with another embodiment of the present invention, each blade comprises a stagger of between about 15° and 40° at the blade hub, between about 45° and 65° at the blade midspan and between about 50° and 70° at the blade tip. Also, each blade may comprise a solidity of between about 1.2 and 2.2 at the blade hub, between about 1.0 and 1.7 at the blade midspan and between about 0.7 and 1.5 at the blade tip, and a chord of about 1.0 at the blade hub, between about 1.0 and 1.2 at the blade midspan and between about 0.85 and 1.25 at the blade tip.

In accordance with a further embodiment of the invention, the cooling fan comprises an outlet guide vane assembly which includes a plurality of radially extending guide vanes, each of which comprises a vane hub, a vane tip and a vane midspan approximately midway between the vane hub and the vane tip. In addition, each guide vane comprises a camber of between about 40° and 75° at the vane hub, between about 30° and 65° at the vane midspan and between about 40° and 70° at the vane tip.

In accordance with yet another embodiment of the invention, each guide vane comprises a stagger of between about 15° and 30° at the vane hub, between about 12° and 25° at the vane midspan and between about 15° and 30° at the vane tip. In addition, each guide vane may comprise a solidity of between about 1.5 and 3.0 at the vane hub, between about 1.0 and 2.0 at the vane midspan and between about 0.8 and 1.6 at the vane tip, and a chord of about 1.0 at the vane hub, between about 0.75 and 0.95 at the vane midspan and between about 0.75 and 0.95 at the blade tip.

In accordance with still another embodiment of the invention, each guide vane includes a leading edge which comprises a bow angle at the vane hub of other than 0° and a bow angle at the vane tip of other than 0°. Furthermore, each guide vane may include a trailing edge which comprises a bow angle at the vane hub of other than 0° and a bow angle at the vane tip of other than 0°. Furthermore, the leading edge of each guide vane may be swept axially aft between about 5° and 20°.

In general, the cooling fan of the present invention may include an impeller which comprises a plurality of radially extending impeller blades, an outlet guide vane assembly which comprises a plurality of radially extending guide vanes, and an optional diffuser section which is located downstream of the outlet guide vane assembly.

The impeller and the outlet guide vane assembly may be aerodynamically designed using three-dimensional computational fluid dynamics to ensure that flow weakness is minimized and efficiency is maximized. For example, the impeller blades and guide vanes may be designed using numerous tailored airfoil segments, and bow and lean may be incorporated into the blades and vanes in order to achieve maximum performance and range. In addition, the leading edge of the guide vanes may be swept aft to reduce the amount of noise generated by the fan.

Bow may be incorporated into the guide vanes to help balance the aerodynamic loading across the vanes in the spanwise direction. Increasing bow in this direction reduces the aerodynamic loading of the airfoil segments near the end walls and results in increased loading of the airfoil segments near the midspan. Bow also tends to energize the end wall boundary layers, making them less susceptible to separation. The outlet guide vanes may comprise a leading edge that is especially curved near the hub and the tip. The trailing edge may be bowed in the same direction and to a greater degree than the leading edge.

These and other objects and advantages of the present invention will be made apparent from the following detailed description, with reference to the accompanying drawings. In the drawings, the same reference numbers are used to denote similar components in the various embodiments.

DETAILED DESCRIPTION OF THE INVENTION

The present invention is applicable to a variety of air movers. However, for purposes of brevity it will be described in the context of an exemplary vane-axial cooling fan. Nevertheless, the person of ordinary skill in the art will readily appreciate how the teachings of the present invention can be applied to other types of air movers. Therefore, the following description should not be construed to limit the scope of the present invention in any manner.

Figure 1:
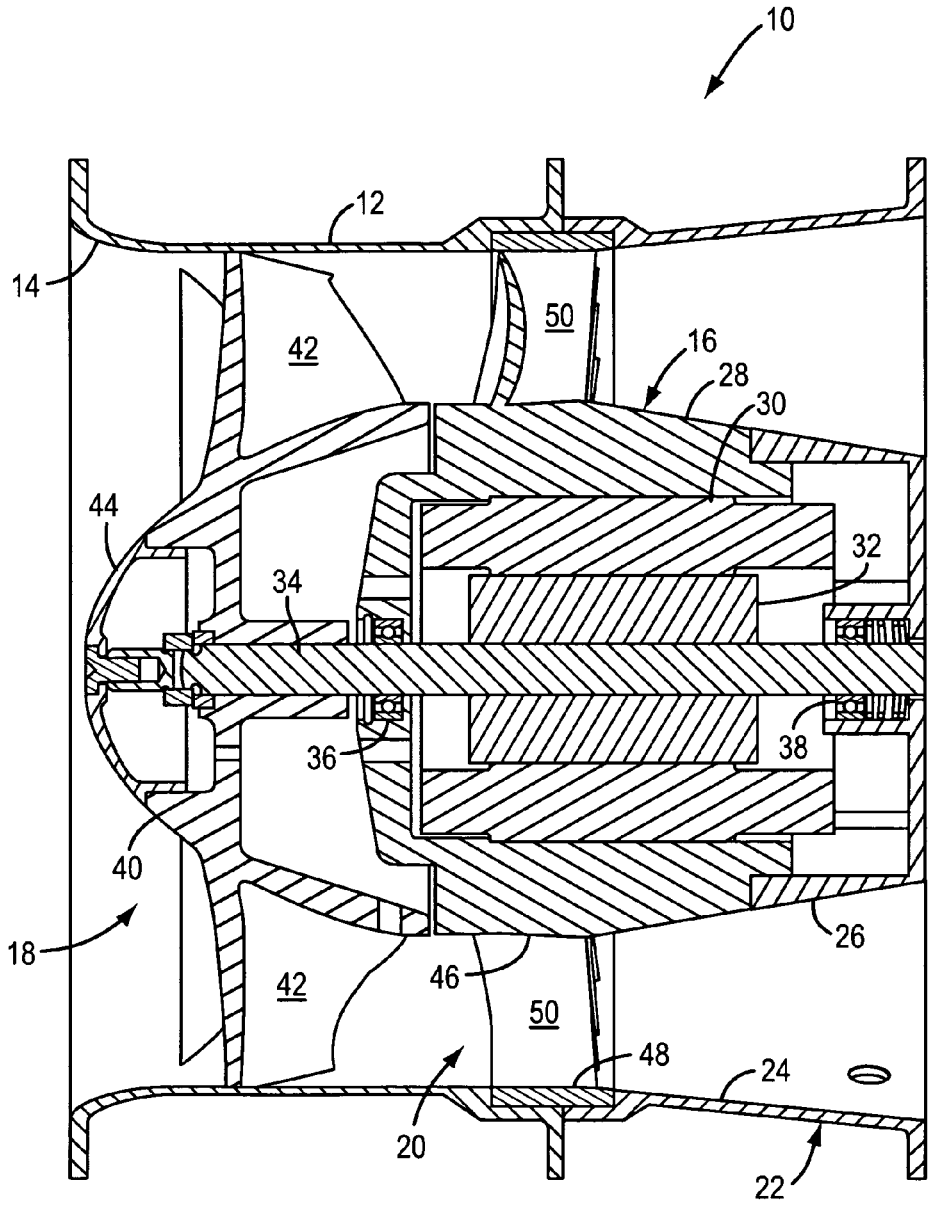
FIG. 1 is a cross sectional view of an exemplary vane axial cooling fan.

Referring to FIG. 1, an exemplary vane axial cooling fan 10 is shown to comprise a fan housing 12 which includes a converging inlet 14, a motor 16 which is supported in the fan housing, an impeller 18 which is driven by the motor, and an outlet guide vane assembly 20 which extends radially between the motor and the fan housing. The cooling fan 10 may also include a diffuser section 22 which is located downstream of the outlet guide vane assembly and which includes a diffuser tube 24 that is connected to or formed integrally with the fan housing 12 and a tail cone 26 that is connected to or formed integrally with the downstream end of the motor 16.

The motor 16 includes a motor housing 28, a stator 30 which is mounted within the motor housing, a rotor 32 which is positioned within the stator, and a rotor shaft 34 which is connected to the rotor. The rotor shaft 34 is rotationally supported in a front bearing 36 which is mounted in the motor housing 28 and a rear bearing 38 which is mounted in the tail cone 26.

The impeller 18 comprises an impeller hub 40 which is connected to the rotor shaft 34 by suitable means and a number of impeller blades 42 which extend radially outwardly from the impeller hub. The impeller hub 40 is sloped so that the annular area around the upstream end of the impeller 18 is larger than the annular area around the downstream end of the impeller. As is known in the art, this configuration reduces the static pressure rise of the air across the impeller 18. The impeller hub 40 may also include a removable nose cone 44 to facilitate mounting the impeller 16 to the rotor shaft 34.

Examples of four impellers 18 which are suitable for use in the present invention are shown in FIGS. 3A through 3D. For purposes of identification, the impellers of FIGS. 3A through 3D are referred to as impeller designs A, B, C and D, respectively.

Referring still to FIG. 1, the outlet guide vane assembly 20 includes a hub 46 which is attached to or formed integrally with the motor housing 28, an outer ring 48 which is secured to the fan housing 12 by suitable means, and a plurality of guide vanes 50 which extend radially between the hub and the outer ring. Representative portions of four exemplary outlet guide vane assemblies 20 which are suitable for use in the present invention are shown in FIGS. 4A through 4D. As with the impellers 18 shown in FIGS. 3A through 3D, the outlet guide vane assemblies of FIGS. 4A through 4D are referred to for identification purposes as guide vane Designs A, B, C and D, respectively. Moreover, each of these outlet guide vane assemblies 20 may be matched with the impeller 18 of the same name when designing a particular cooling fan 10.

In operation of the cooling fan 10, the motor 16 spins the impeller 18 to draw air into and through the fan housing 12. The converging inlet 14 delivers a uniform, axial air stream to the impeller 18 and contracts the air stream slightly to mitigate the performance and noise penalties normally associated with inlet flow distortion. As the air stream flows through the impeller 18, the sloping impeller hub 40 reduces the static pressure rise of the air stream. The guide vanes 50 then receive the swirling air stream from the impeller 18 and turn the air stream in substantially the axial direction. In the process of deswirling the air stream, the static pressure of the air increases. The diffuser section 22 receives the air stream from the outlet guide vane assembly 20 and decelerates it to further increase the static pressure of the air.

Figure 2:
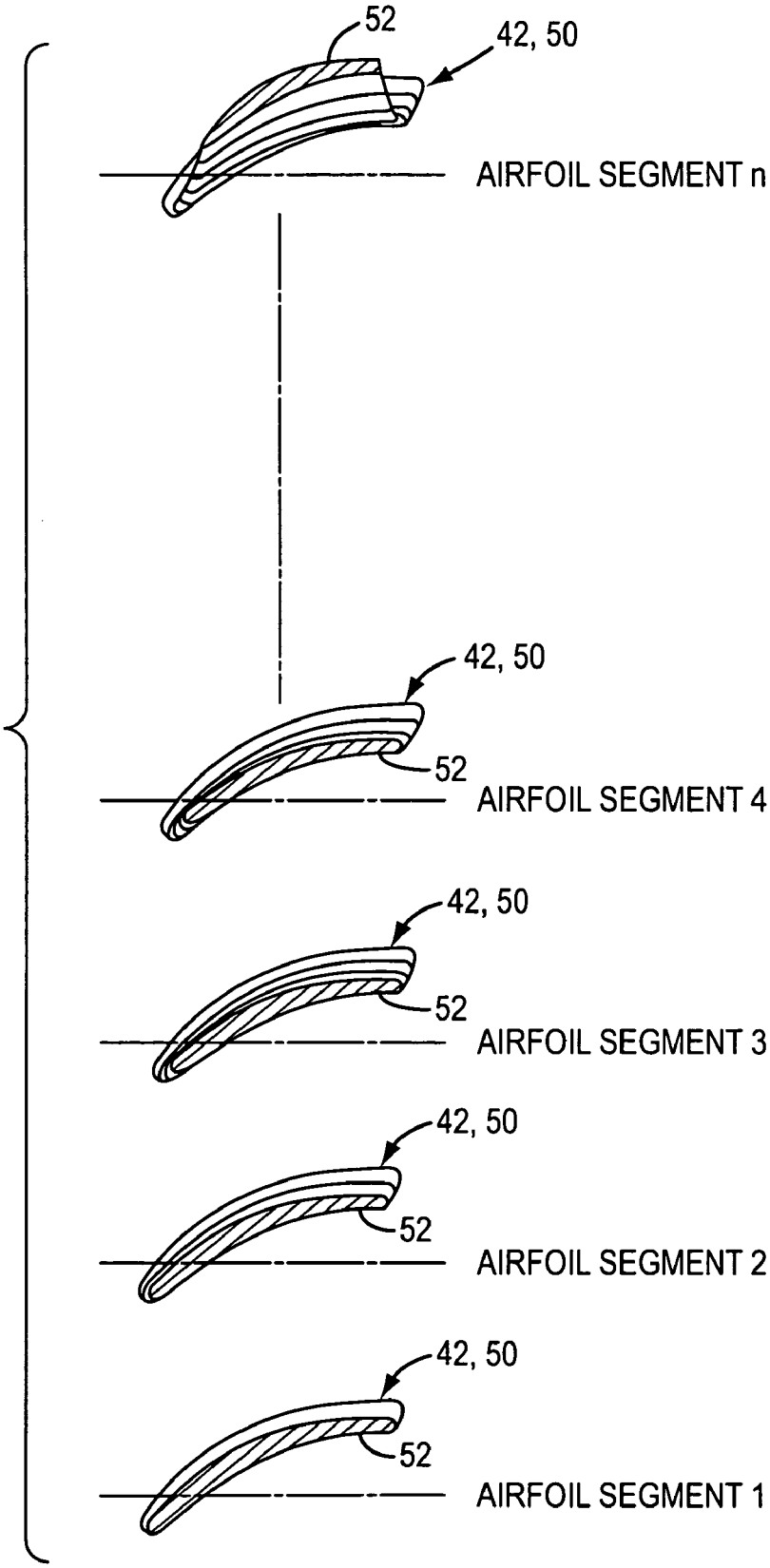
FIG. 2 is a representation of a succession of radially spaced airfoil segments of an exemplary impeller blade or outlet guide vane, with Airfoil Segment 1 being closest to the hub of the blade or vane and Airfoil Segment n being closest to the tip of the blade or vane.
Figure 3A:
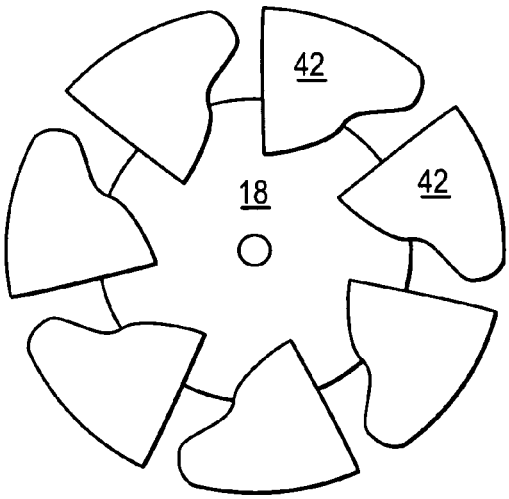
FIGS. 3A through 3D are front views of four embodiments of an impeller of the present invention.
Figure 3B:
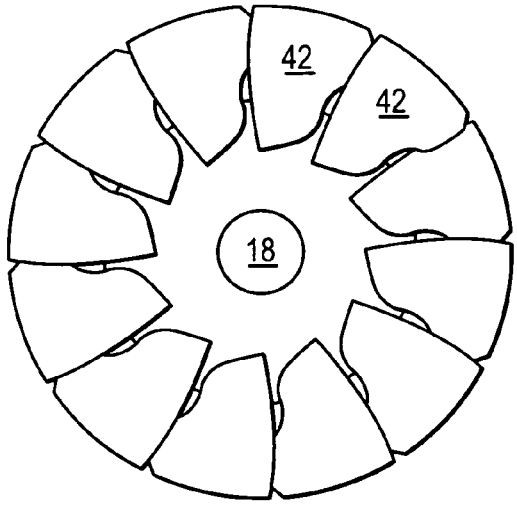
Figure 3C:
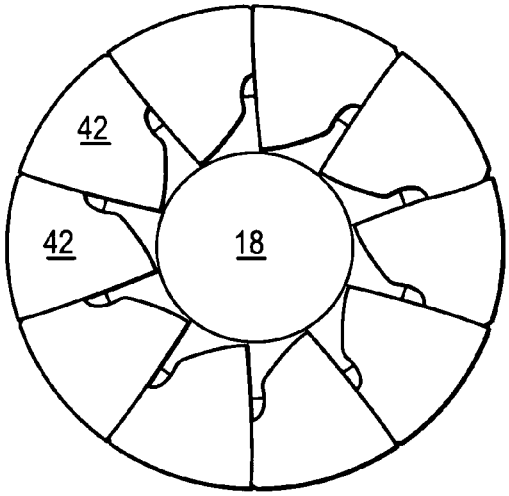
Figure 3D:
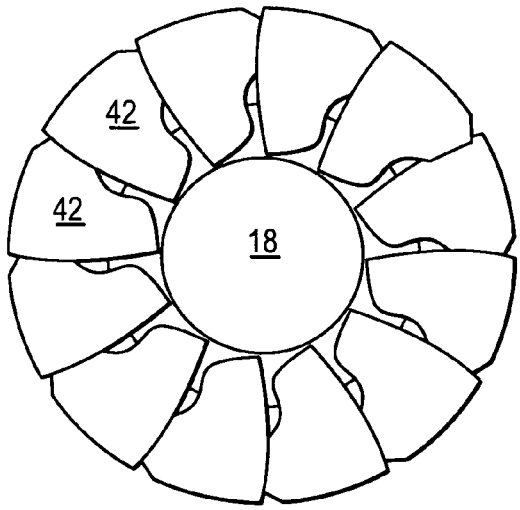
Figure 4A:
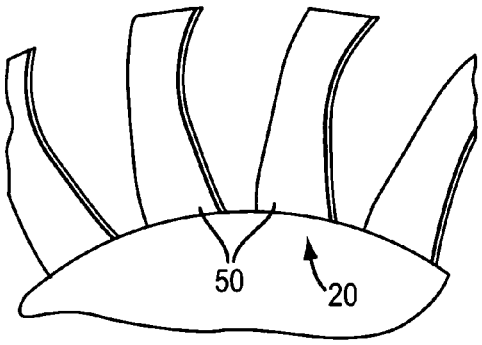
FIGS. 4A through 4D are partial front views of four embodiments of an outlet guide vane assembly of the present invention.
Figure 4B:
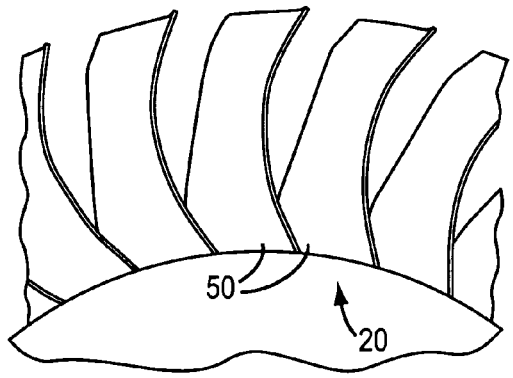
Figure 4C:
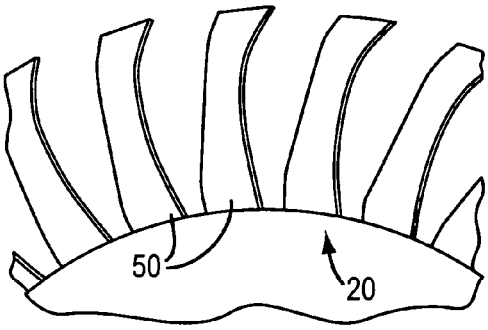
Figure 4D:
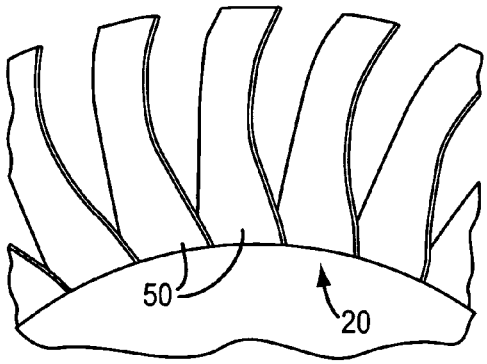

Each of the impeller blades 42 and the outlet guide vanes 50 may be considered to comprise a radial stack of a number of individual airfoil segments. As shown in FIG. 2, each airfoil segment 52 represents a cross section of the impeller blade 42 or the guide vane 50 at a specific radial distance from its hub. The number of airfoil segments 52 which each impeller blade 42 and guide vane 50 is designed to have is dependent in part on the required configuration of these components. In one embodiment of the present invention, each of the impeller blades 42 is designed to comprise six airfoil segments 52 and each of the guide vanes 50 is designed to comprise six airfoil segments 52.

Figure 5:
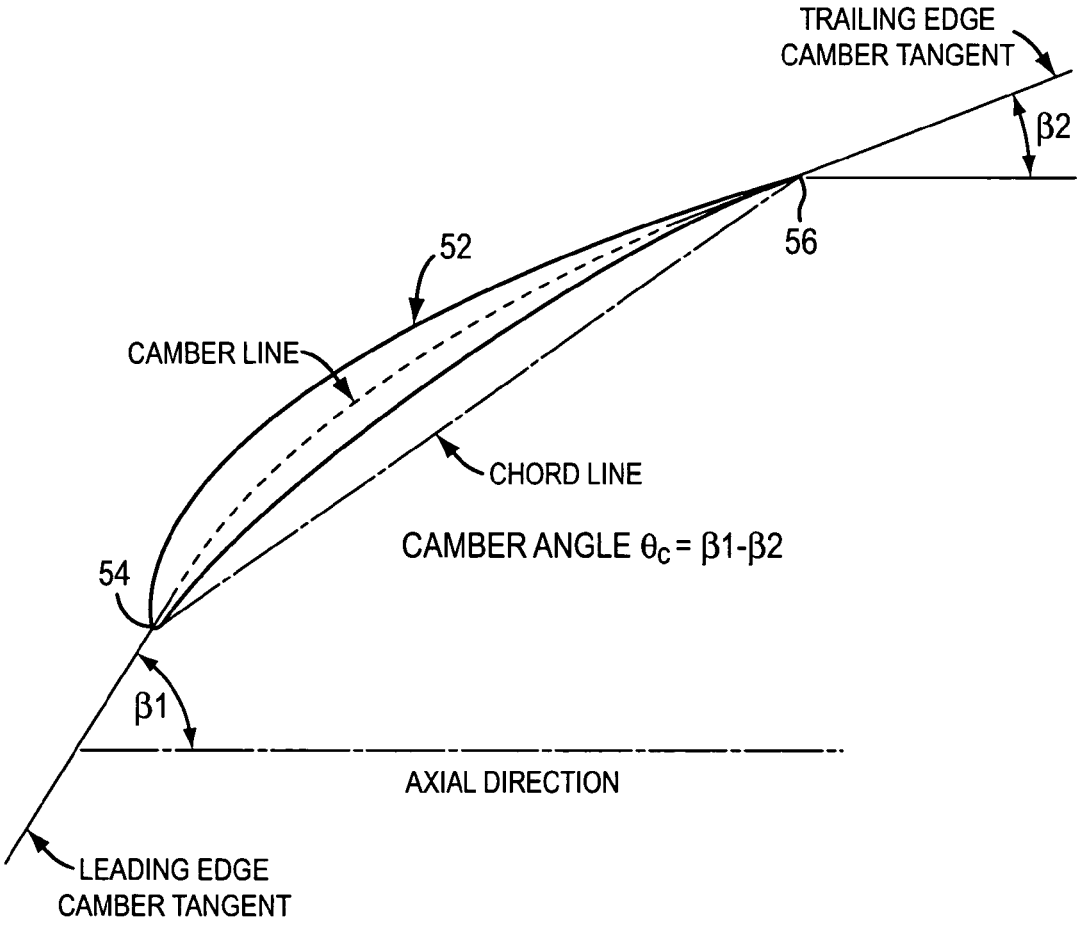
FIG. 5 is a representation of an exemplary airfoil segment illustrating several identifying features of the segment.

Referring to FIG. 5, an exemplary airfoil segment 52 comprises a leading edge 54 and a trailing edge 56, with the airfoil segment being oriented such that the air stream meets the airfoil segment at the leading edge and departs the airfoil segment at the trailing edge. An airfoil segment may be defined in terms of its camber angle, chord and stagger angle. The camber line is the curve extending from the leading edge 54 to the trailing edge 56 through the middle of the airfoil segment 52. The camber angle $\theta_C$ is the difference between the leading edge camber angle $\beta_1$ (i.e., the angle of the camber line at the leading edge 54, relative to the axial direction) and the trailing edge camber angle $\beta_2$ (i.e., the angle of the camber line at the trailing edge 56, relative to the axial direction). The chord is the straight line distance between the leading and trailing edges 54, 56 of the airfoil segment 52. The angle that this chord line makes relative to the axial direction defines the stagger angle.

Other terms used to characterize the shape of an impeller and an outlet guide vane assembly are solidity and aspect ratio. Solidity is defined as the ratio of the chord of an airfoil segment to the spacing between that segment and a tangentially adjacent airfoil segment. Aspect ratio is defined as the ratio of the average height of the blade or vane to the average chord of the blade or vane.

The shape of the impeller blades 42 is important to achieving high efficiency and reducing the rotational speed required for a given pressure rise. In accordance with the present invention, each impeller blade 42 comprises the preferred values of camber, stagger, solidity and normalized chord set forth in Table 1.

TABLE 1

Impeller Blade Geometry

| | Hub | Midspan | Tip |
|---|---|---|---|
| Camber (degrees) | 60-90, preferably 60-85 | 15-40, preferably 20-40 | 15-40, preferably 20-40 |
| Stagger (degrees) | 15-40, preferably 20-35 | 45-65, preferably 50-60 | 50-70, preferably 55-65 |
| Solidity | 1.2-2.2, preferably 1.4-2.1 | 1.0-1.7, preferably 1.1-1.6 | 0.7-1.5, preferably. 0.8-1.2 |
| Chord | 1 | 1.0-1.2, preferably 1.0-1.15 | 0.85-1.25, preferably 0.9-1.2 |

Figure 6A:
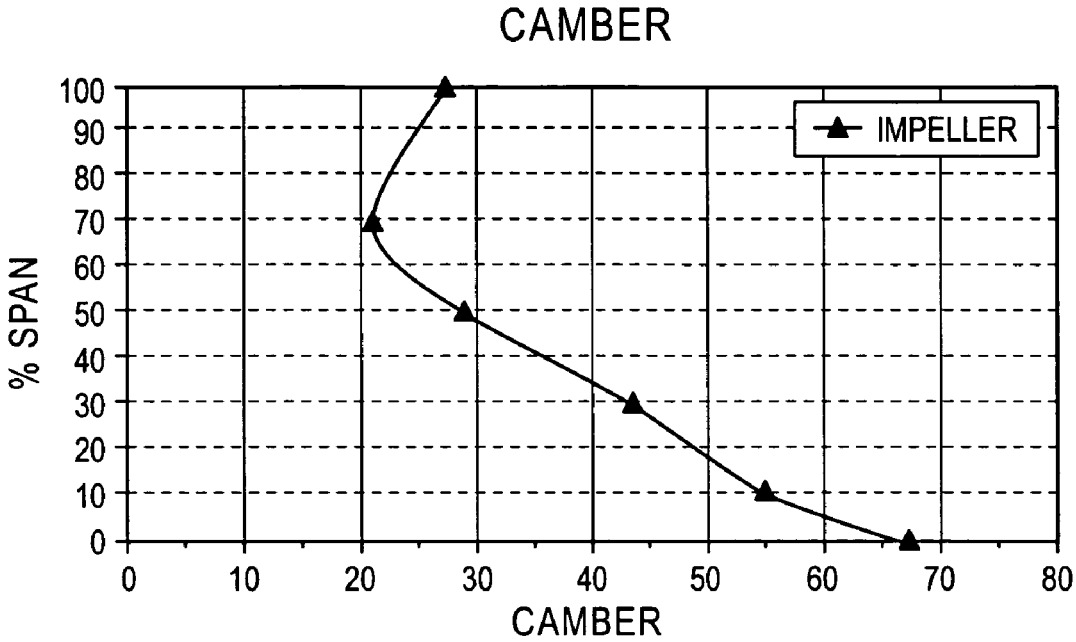
FIGS. 6A through 6D are graphs showing the values of camber, stagger, solidity and normalized chord, respectively, for the four impeller embodiments illustrated in FIGS. 3A through 3D.
Figure 6B:
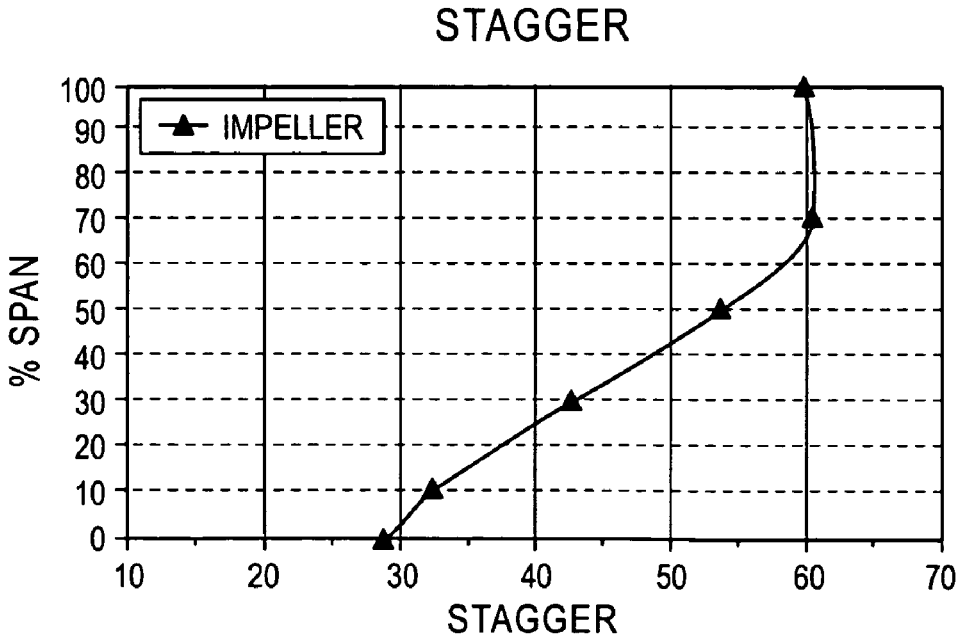
Figure 6C:
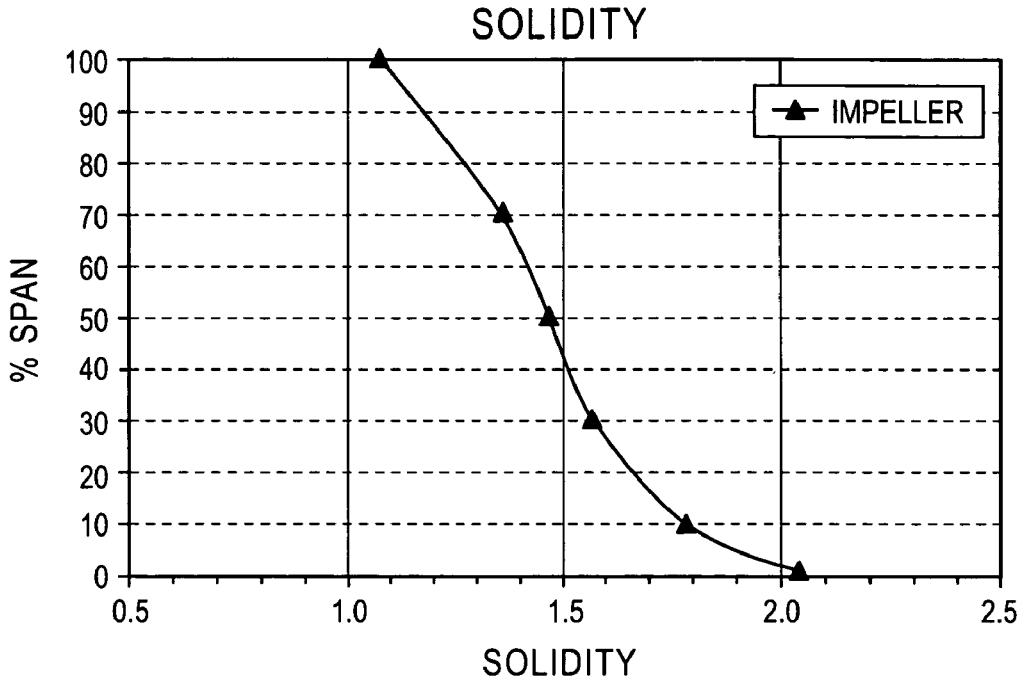
Figure 6D:
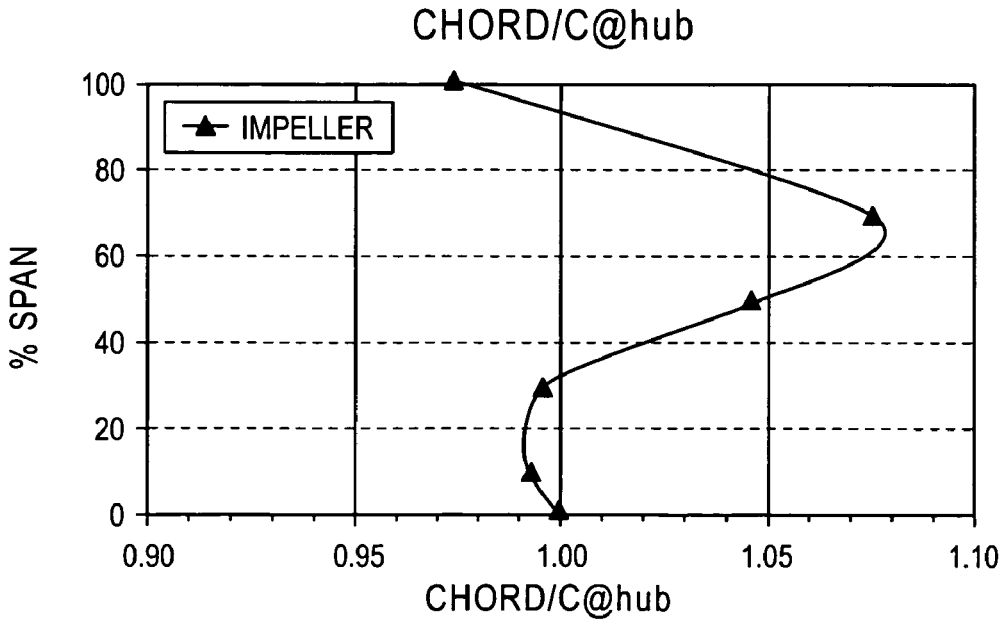

In accordance with an exemplary embodiment of the invention, each impeller blade 42 comprises the values of camber, stagger, solidity and normalized chord shown in FIGS. 6A through 6D, respectively. As shown in FIG. 6A, camber is highest in the hub region, then decreases with increasing span to a minimum at about 70% of the span, and then increases with increasing span out to the tip. Referring to FIG. 6B, stagger is lowest at the hub, increases to a maximum near about 70% of the span, and then is nearly constant, or decreases slightly, out to the tip. Referring to FIG. 6C, solidity is maximum at the hub and decreases to a minimum at the tip. Finally, as shown in FIG. 6D, the normalized chord increases from the hub to a maximum near 70% of the span and then decreases out to the tip.

The shape of the outlet guide vanes 50 is also important to achieving the required performance characteristics for a given application. In accordance with the present invention, each guide vane 50 comprises the preferred values of camber, stagger, solidity and normalized chord set forth in Table 2.

TABLE 2

Guide Vane Geometry

| | Hub | Midspan | Tip |
|---|---|---|---|
| Camber (degrees) | 40-75, preferably 45-73 | 30-65, preferably 35-60 | 40-70, preferably 45-65 |
| Stagger (degrees) | 15-30, preferably 20-30 | 12-25, preferably 15-22 | 15-30, preferably 20-28 |
| Solidity | 1.5-3.0, preferably 1.8-2.9 | 1.0-2.0, preferably 1.2-1.9 | 0.8-1.6, preferably 1.0-1.5 |
| Chord | 1.0 | 0.75-0.95, preferably 0.8-0.9 | 0.75-0.95, preferably 0.78-0.9 |

Figure 7A:
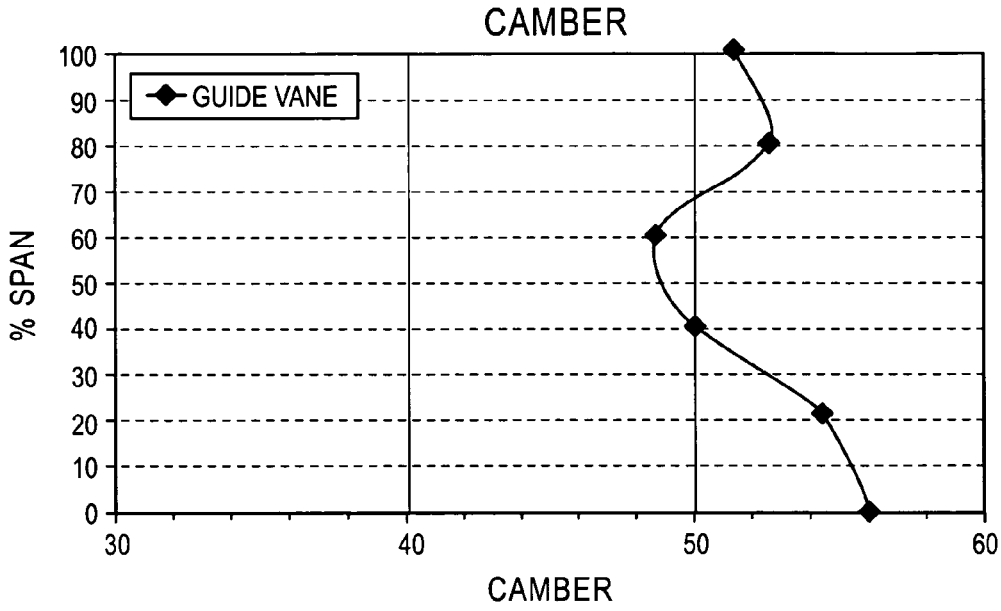
FIGS. 7A through 7D are graphs showing the values of camber, stagger, solidity and normalized chord, respectively, for four embodiments of an outlet guide vane assembly of the present invention.
Figure 7B:
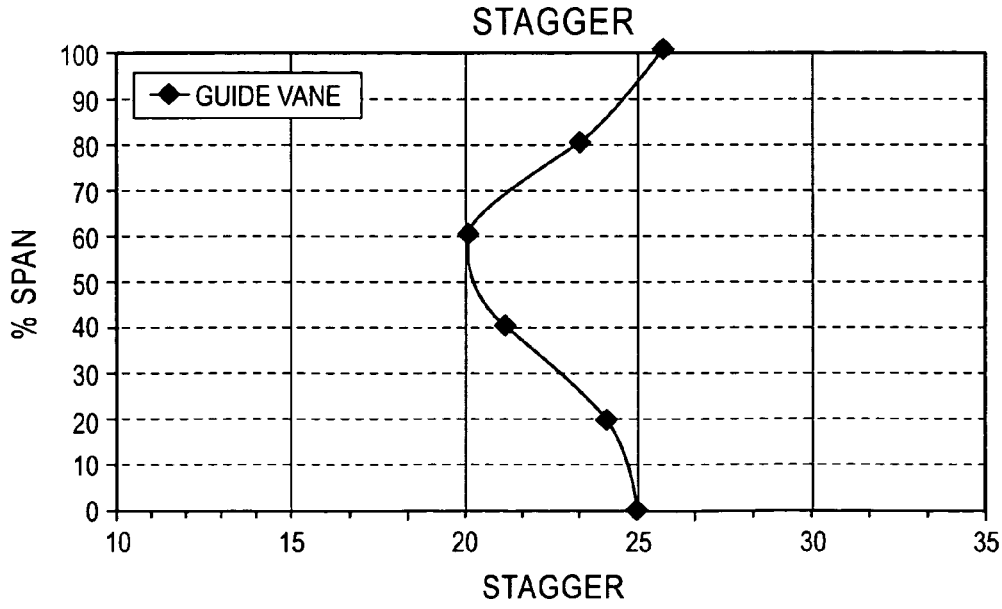
Figure 7C:
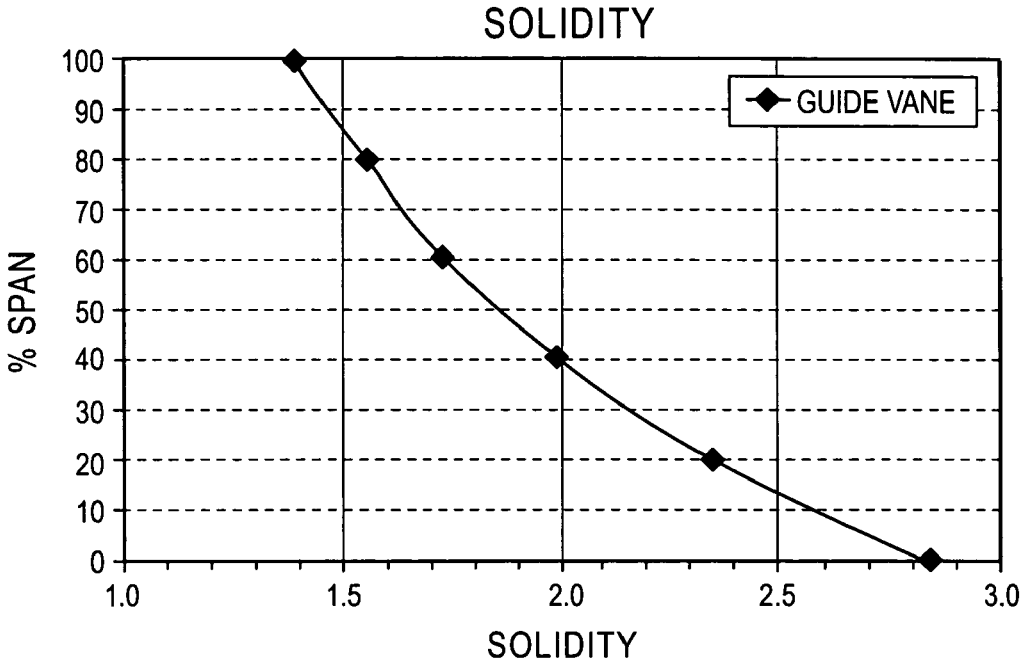
Figure 7D:
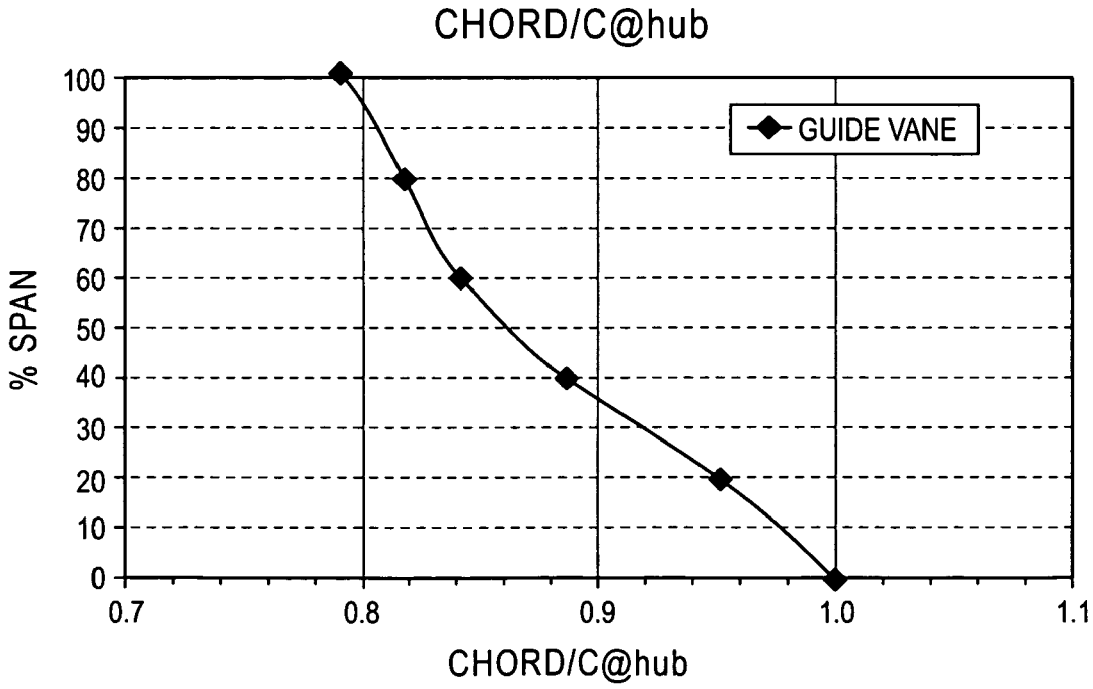

In accordance with an exemplary embodiment of the invention, each guide vane 50 comprises the values of camber, stagger, solidity and normalized chord shown in FIGS. 7A through 7D, respectively. As shown in FIG. 7A, camber is highest in the hub region, decreases with increasing span to a minimum near midspan, and then increases with increasing span out to the tip. As shown in FIG. 7B, stagger is highest in the hub and tip regions and lowest near midspan. As shown in FIG. 7C, solidity is maximum at the hub and decreases to a minimum at the tip. Finally, as shown in FIG. 7D, normalized chord decreases from the hub to the tip.

Representative aspect ratios for the impeller and outlet guide vane embodiments depicted in FIGS. 3A through 3D and in FIGS. 4A through 4D, respectively, are provided in Table 3.

TABLE 3

Impeller Blade and Guide Vane Aspect Ratios

| Embodiment | Impeller Blade Aspect Ratio | Guide Vane Aspect Ratio |
|---|---|---|
| Design A | 0.6 | 1.0 |
| Design B | 0.8 | 1.2 |
| Design C | 0.6 | 1.4 |
| Design D | 0.9 | 1.7 |

When the two-dimensional airfoil segments 52 are stacked together to form the impeller blades 40 and the guide vanes 50, the locus of the leading edge points forms the leading edge line of the blade or vane and the locus of the trailing edge points forms the trailing edge line of the blade or vane. These leading and trailing edge lines can take a variety of forms: they may be straight and radial, they may be straight with lean, or they may be curved, introducing bow into the blade or vane.

Bow and lean are conventionally used in impeller blades. However, the use of these features in the guide vanes 50 of the present invention is believed to be unique. Bow is incorporated into the guide vanes 50 to help balance the aerodynamic loading in the spanwise direction of the vanes. Increasing bow in this direction reduces the aerodynamic loading of the airfoil segments 52 near the endwalls (i.e., the radially inner and outer ends of the vanes) and results in increased loading of the airfoil segments near the midspan of the vanes. Bow also tends to energize the end wall boundary layers, making them less susceptible to separation.

Figure 8:
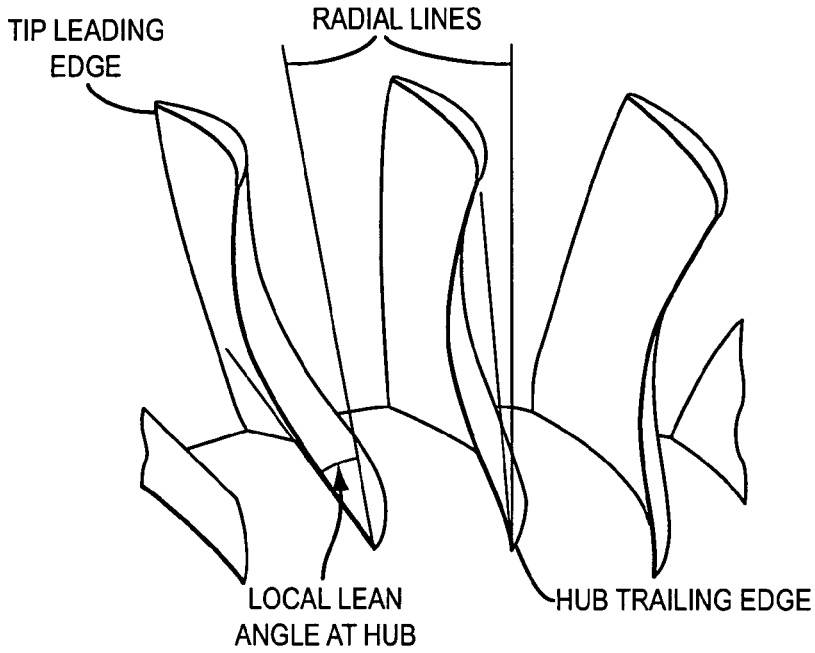
FIG. 8 is an aft-looking-forward view of a number of the guide vanes of an exemplary outlet guide vane assembly which illustrates several identifying features of the guide vanes.

Referring to FIG. 8, bow and lean can be illustrated using a representation of a number of guide vanes viewed from an aft-looking-forward position. In this embodiment, the trailing edge of the guide vanes is bowed, or curved, rather than straight between the hub and the tip. In addition, a straight line connecting the trailing edge hub point with the trailing edge tip point is leaned in the tangential direction relative to the radial direction. Also, the guide vanes may comprise a local lean angle at the hub or the tip, or both.

Figure 9:
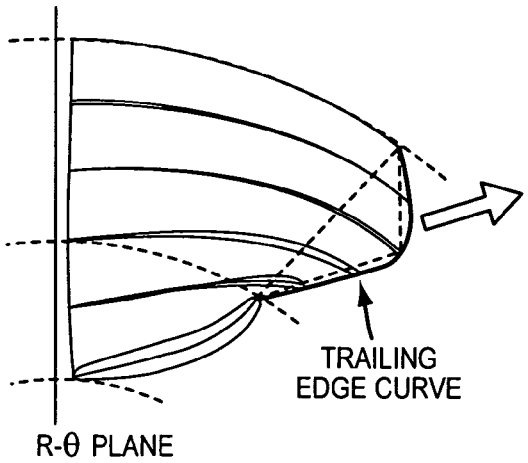
FIG. 9 is front representation of an exemplary impeller blade which illustrates several identifying features of the blade.
Figure 9A:
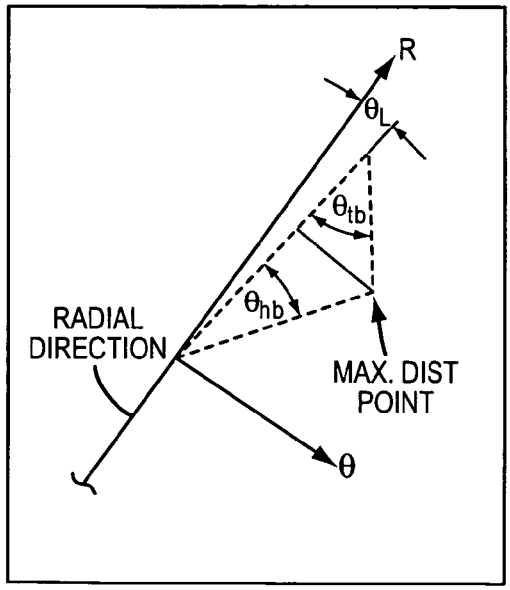
FIG. 9A is an isolated view of the portion of the impeller blade identified by dotted lines in FIG. 9.
Figure 9B:
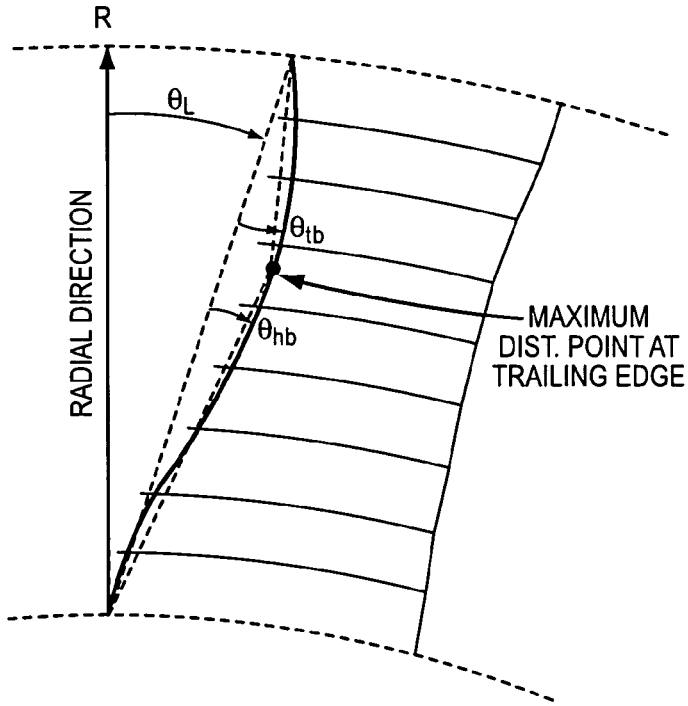
FIG. 9B is a representation of an exemplary outlet guide vane which illustrates several identifying features of the vane.

A convenient way to describe bow and lean for a general leading or trailing edge curve is illustrated in FIG. 9. Here, a front projection (i.e., a projection in the R-θ plane) of an impeller blade is made and, in this case, the trailing edge curve is highlighted. A line is then drawn between the trailing edge hub point and the trailing edge tip point. As shown in FIG. 9A, the angle this line makes with the radial direction R is the lean angle $\theta_L$, and in this particular case the lean angle is positive. For purposes of comparison, a front projection of a guide vane is depicted in FIG. 9B, and the lean angle $\theta_L$ of the trailing edge of the guide vane is likewise positive.

To quantify bow, a triangle is drawn between the trailing edge hub point, the trailing edge tip point and a point on the trailing edge curve which is farthest from the line connecting these two points. The angles $\theta_{hb}$ and $\theta_{tb}$ of this triangle describe the degree of bow at the hub and the tip, respectively, of the blade or vane. Positive bow angles for an impeller blade trailing edge and a guide vane trailing edge are shown in FIGS. 9A and 9B, respectively. Referring to FIG. 9B, in this embodiment the guide vane trailing edge lean and bow angles are such that the vane suction surface makes an obtuse angle with the adjacent flowpath wall at both the hub and the tip.

Representative values of lean and bow for the impeller and outlet guide vane embodiments depicted in FIGS. 3A through 3D and in FIGS. 4A through 4D, respectively, are provided in Table 4.

TABLE 4

| Lean and Bow Values | | | |
|---|---|---|---|
| Embodiment | Lean angle ($\theta_L$) (degrees) | Bow angle @ hub ($\theta_{hb}$) (degrees) | Bow angle @ tip ($\theta_{tb}$) (degrees) |
| Impeller Blade Leading Edge | | | |
| Design A | 0 | 1 | 1 |
| Design B | 0 | 5 | 6 |
| Design C | 0 | 1 | 1 |
| Design D | −1 | 6 | 5 |
| Impeller Blade Trailing Edge | | | |
| Design A | 20 | 23 | 38 |
| Design B | 6 | 21 | 35 |
| Design C | 9 | 34 | 40 |
| Design D | 12 | 30 | 48 |
| Guide Vane Leading Edge | | | |
| Design A | −14 | 4 | 9 |
| Design B | −16 | 18 | 6 |
| Design C | −14 | 4 | 10 |
| Design D | −12 | 5 | 12 |
| Guide Vane Trailing Edge | | | |
| Design A | 1 | 14 | 17 |
| Design B | 2 | 16 | 19 |
| Design C | −4 | 12 | 20 |
| Design D | 5 | 14 | 16 |

Figure 10:
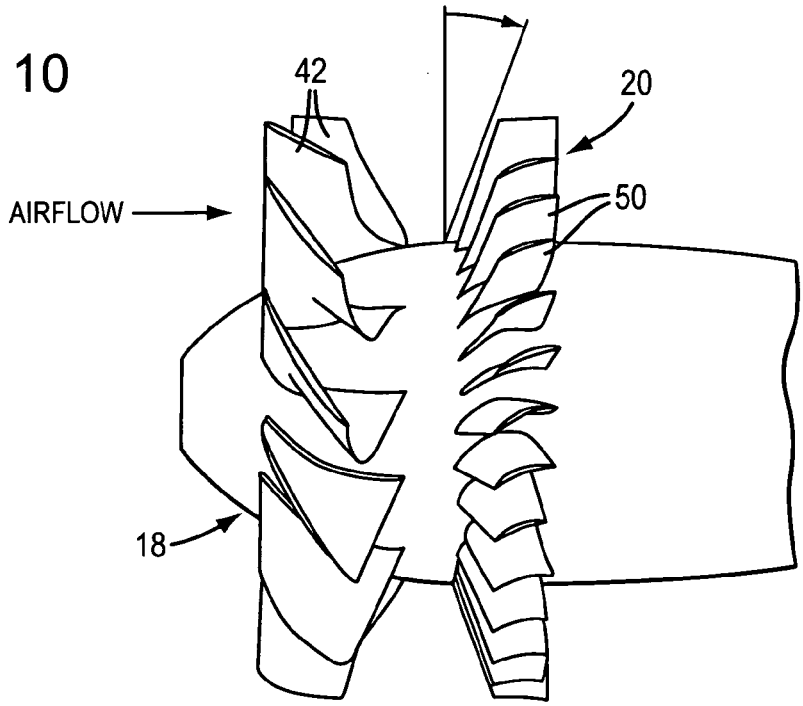
FIG. 10 is a side view of the impeller and outlet guide vane assembly in accordance with one embodiment of the present invention.

In accordance with a further aspect of the invention, which is illustrated in FIG. 10, the leading edge of each guide vane 50 is swept aft to increase the axial gap between this edge and the trailing edge of the impeller blade 42, especially at the tip. In this regard, axial sweep is defined in the Z-R plane (i.e., the plane of the paper in FIG. 1) as the angle between a radial line and a line joining the hub and the tip of the leading edge of the guide vane. The degree that the leading edge of each guide vane is swept aft can be between about 5 degrees and about 20 degrees, more preferably between about 5 degrees and about 15 degrees, and most preferably about 10 degrees. Incorporating such axial sweep into the leading edge of the guide vanes 50 has been shown to reduce the noise output of the cooling fan 10.

When incorporated into the cooling fan 10, the impeller and outlet guide vane assembly configurations discussed above yield relatively large efficiencies. One measure of a fan's efficiency is the total-to-static efficiency. This value is given by the following equation:

$$\eta_{T\text{-}S}=[(P_{s,exit}/P_{t,inlet})\hat{}(\gamma-1/\gamma)-1]/[(T_{t,exit}/T_{t,inlet})-1], \quad (1)$$

where $P_{s,exit}$ is the exit static pressure, $P_{t,inlet}$ is the inlet total pressure, $T_{t,inlet}$ is the inlet total temperature, $T_{t,exit}$ is the exit total temperature, and $\gamma$ is the specific heat ratio of the working fluid.

Another measure of a fan's efficiency is the total-to-total efficiency, which is given by the following equation:

$$\eta_{T\text{-}T}=[(P_{t,exit}/P_{t,inlet})\hat{}(\gamma-1/\gamma)-1]/[(T_{t,exit}/T_{t,inlet})-1] \quad (2)$$

where $P_{t,exit}$ is the exit total pressure, $P_{t,inlet}$ is the inlet total pressure, $T_{t,inlet}$ is the inlet total temperature, $T_{t,exit}$ is the exit total temperature, and $\gamma$ is the specific heat ratio of the working fluid.

When constructed in accordance with the present invention, each embodiment of the cooling fan 10 was found to have a total-to-static efficiency near 70% and a total-to-total efficiency near 90%. These efficiencies are a considerable improvement over many prior art cooling fans.

Another measure of the performance of a fan is Work Coefficient, which is defined by the following formula:

$$\text{Work Coefficient}=(2\times\Delta H)/u^2, \quad (1)$$

where $\Delta H$ is the total enthalpy rise and u is the impeller inlet pitch line wheel speed. In accordance with the present invention, the Work Coefficient for the cooling fan 10 is between about 1 and 1.5.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

We claim:

1. A cooling fan which comprises:

an impeller which includes a plurality of radially extending blades, each of which includes a blade hub, a blade tip and a blade midspan approximately midway between the hub and the tip;

wherein each blade comprises a camber of between about 60° and 90° at the blade hub, between about 15° and 40° at the blade midspan and between about 15° and 40° at the blade tip; and wherein each blade further comprises a leading edge which comprises a lean angle of about 0°, a bow angle at the blade hub of about 1° and a bow angle at the blade tip of about 1°, and a trailing edge which comprises a lean angle of about 20°, a bow angle at the blade hub of about 23° and a bow angle at the blade tip of about 38°.

2. The cooling fan of claim 1, wherein each blade comprises a camber of between about 60° and 85° at the blade hub, between about 20° and 40° at the blade midspan and between about 20° and 40° at the blade tip.

3. The cooling fan of claim 1, wherein each blade comprises a stagger of between about 15° and 40° at the blade hub, between about 45° and 65° at the blade midspan and between about 50° and 70° at the blade tip.

4. The cooling fan of claim 3, wherein each blade comprises a stagger of between about 20° and 35° at the blade hub, between about 50° and 60° at the blade midspan and between about 55° and 65° at the blade tip.

5. The cooling fan of claim 1, wherein each blade comprises a solidity of between about 1.2 and 2.2 at the blade hub, between about 1.0 and 1.7 at the blade midspan and between about 0.7 and 1.5 at the blade tip.

6. The cooling fan of claim 5, wherein each blade comprises a solidity of between about 1.4 and 2.1 at the blade hub, between about 1.1 and 1.6 at the blade midspan and between about 0.8 and 1.2 at the blade tip.

7. The cooling fan of claim 1, wherein each blade comprises a normalized chord of about 1.0 at the blade hub, between about 1.0 and 1.2 at the blade midspan and between about 0.85 and 1.25 at the blade tip.

8. The cooling fan of claim 7, wherein each blade comprises a normalized chord of about 1.0 at the blade hub, between about 1.0 and 1.15 at the blade midspan and between about 0.9 and 1.2 at the blade tip.

9. The cooling fan of claim 1, wherein the camber of each blade is maximum near the blade hub and minimum at a point about 70% of the distance from the blade hub to the blade tip.

10. The cooling fan of claim 1, wherein each blade comprises a stagger which is minimum near the blade hub, maximum at a point about 70% of the distance from the blade hub to the blade tip, and approximately constant from the point to the blade tip.

11. The cooling fan of claim 1, wherein each blade comprises a solidity which is maximum near the blade hub and decreases to a minimum near the blade tip.

12. The cooling fan of claim 1, wherein each blade comprises a normalized chord which increases from the blade hub to a maximum at a point about 70% of the distance from the blade hub to the blade tip, and then decreases from the point to the blade tip.

13. The cooling fan of claim 1, further comprising:

an outlet guide vane assembly which includes a plurality of radially extending guide vanes, each of which comprises a vane hub, a vane tip and a vane midspan approximately midway between the vane hub and the vane tip;

wherein each guide vane comprises a camber of between about 40° and 75° at the vane hub, between about 30° and 65° at the vane midspan and between about 40° and 70° at the vane tip.

14. The cooling fan of claim 13, wherein each guide vane comprises a stagger of between about 15° and 30° at the vane hub, between about 12° and 25° at the vane midspan and between about 15° and 30° at the vane tip.

15. The cooling fan of claim 13, wherein each guide vane comprises a solidity of between about 1.5 and 3.0 at the vane hub, between about 1.0 and 2.0 at the vane midspan and between about 0.8 and 1.6 at the vane tip.

16. The cooling fan of claim 13, wherein each guide vane comprises a normalized chord of about 1.0 at the vane hub, between about 0.75 and 0.95 at the vane midspan and between about 0.75 and 0.95 at the blade tip.

17. A cooling fan which comprises:

an impeller which includes a plurality of radially extending blades, each of which includes a blade hub a blade tip and a blade midspan approximately midway between the hub and the tip;

wherein each blade comprises a camber of between about 60° and 90° at the blade hub, between about 15° and 40° at the blade midspan and between about 15° and 40° at the blade tip; and wherein each blade includes:

a leading edge which comprises a lean angle of about 0°, a bow angle at the blade hub of about 5° and a bow angle at the blade tip of about 6°; and a trailing edge which comprises a lean angle of about 6°, a bow angle at the blade hub of about 21° and a bow angle at the blade tip of about 35°.

18. A cooling fan which comprises:

an impeller which includes a plurality of radially extending blades, each of which includes a blade hub, a blade tip and a blade midspan approximately midway between the hub and the tip;

wherein each blade comprises a camber of between about 60° and 90° at the blade hub, between about 15° and 40° at the blade midspan and between about 15° and 40° at the blade tip; and wherein each blade includes:

a leading edge which comprises a lean angle of about 0°, a bow angle at the blade hub of about 1° and a bow angle at the blade tip of about 1°; and a trailing edge which comprises a lean angle of about 9°, a bow angle at the hub of about 34° and a bow angle at the tip of about 40°.

19. A cooling fan which comprises:

an impeller which includes a plurality of radially extending blades, each of which includes a blade hub, a blade tip and a blade midspan approximately midway between the hub and the tip;

wherein each blade comprises a camber of between about 60° and 90° at the blade hub, between about 15° and 40° at the blade midspan and between about 15° and 40° at the blade tip; and wherein each blade includes:

a leading edge which comprises a lean angle of about −1°, a bow angle at the blade hub of about 6° and a bow angle at the blade tip of about 5°; and a trailing edge which comprises a lean angle of about 12°, a bow angle at the blade hub of about 30° and a bow angle at the blade tip of about 48°.

20. A cooling fan which comprises:

an outlet guide vane assembly which includes a plurality of radially extending guide vanes, each of which comprises a vane hub, a vane tip and a vane midspan approximately midway between the vane hub and the vane tip;

wherein each guide vane comprises a camber of between about 40° and 75° at the vane hub, between about 30° and 65° at the vane midspan and between about 40° and 70° at the vane tip; and wherein each guide vane further includes a leading edge which comprises a lean angle of about −14°, a bow angle at the vane hub of about 4° and a bow angle at the vane tip of about 9°, and a trailing edge which comprises a lean angle of about 1°, a bow angle at the vane hub of about 14° and a bow angle at the vane tip of about 17°.

21. The cooling fan of claim 20, wherein each guide vane comprises a camber of between about 45° and 73° at the vane hub, between about 35° and 60° at the vane midspan and between about 45° and 65° at the vane tip.

22. The cooling fan of claim 20, wherein each guide vane comprises a stagger of between about 15° and 30° at the vane hub, between about 12° and 25° at the vane midspan and between about 15° and 30° at the vane tip.

23. The cooling fan of claim 22, wherein each guide vane comprises a stagger of between about 20° and 30° at the vane hub, between about 15° and 22° at the vane midspan and between about 20° and 28° at the vane tip.

24. The cooling fan of claim 20, wherein each guide vane comprises a solidity of between about 1.5 and 3.0 at the vane hub, between about 1.0 and 2.0 at the vane midspan and between about 0.8 and 1.6 at the vane tip.

25. The cooling fan of claim 24, wherein each guide vane comprises a solidity of between about 1.8 and 2.9 at the vane hub, between about 1.2 and 1.9 at the vane midspan and between about 1.0 and 1.5 at the vane tip.

26. The cooling fan of claim 20, wherein each guide vane comprises a normalized chord of about 1.0 at the vane hub, between about 0.75 and 0.95 at the vane midspan and between about 0.75 and 0.95 at the blade tip.

27. The cooling fan of claim 26, wherein each guide vane comprises a normalized chord of about 1.0 at the vane hub, between about 0.8 and 0.9 at the vane midspan and between about 0.78 and 0.90 at the blade tip.

28. The cooling fan of claim 20, wherein the camber of each guide vane is maximum near the vane hub, decreases to a minimum near the vane midspan and increases from the vane midspan to the vane tip.

29. The cooling fan of claim 20, wherein each guide vane comprises a stagger which is approximately maximum near both the vane hub and the vane tip and minimum near the vane midspan.

30. The cooling fan of claim 20, wherein each guide vane comprises a solidity which is maximum near the vane hub and decreases to a minimum near the vane tip.

31. The cooling fan of claim 20, wherein each guide vane comprises a normalized chord which decreases from the vane hub to the vane tip.

32. The cooling fan of claim 20, further comprising:

an impeller which includes a plurality of radially extending blades, each of which includes a blade hub, a blade tip and a blade midspan approximately midway between the hub and the tip;

wherein each blade comprises a camber of between about 60° and 90° at the blade hub, between about 15° and 40° at the blade midspan and between about 15° and 40° at the blade tip.

33. The cooling fan of claim 32, wherein each blade comprises a stagger of between about 15° and 40° at the blade hub, between about 45° and 65° at the blade midspan and between about 50° and 70° at the blade tip.

34. The cooling fan of claim 32, wherein each blade comprises a solidity of between about 1.2 and 2.2 at the blade hub, between about 1.0 and 1.7 at the blade midspan and between about 0.7 and 1.5 at the blade tip.

35. The cooling fan of claim 32, wherein each blade comprises a normalized chord of about 1.0 at the blade hub, between about 1.0 and 1.2 at the blade midspan and between about 0.85 and 1.25 at the blade tip.

36. A cooling fan which comprises:

an outlet guide vane assembly which includes a plurality of radially extending guide vanes, each of which comprises a vane hub, a vane tip and a vane midspan approximately midway between the vane hub and the vane tip;

wherein each guide vane comprises a camber of between about 40° and 75° at the vane hub, between about 30° and 65° at the vane midspan and between about 40° and 70° at the vane tip: and wherein each guide vane includes:

a leading edge which comprises a lean angle of about −16°, a bow angle at the vane hub of about 18° and a bow angle at the vane tip of about 6°; and a trailing edge which comprises a lean angle of about 2°, a bow angle at the vane hub of about 16° and a bow angle at the vane tip of about 19°.

37. A cooling fan which comprises:

an outlet guide vane assembly which includes a plurality of radially extending guide vanes, each of which comprises a vane hub, a vane tip and a vane midspan approximately midway between the vane hub and the vane tip;

wherein each guide vane comprises a camber of between about 40° and 75° at the vane hub, between about 30° and 65° at the vane midspan and between about 40° and 70° at the vane tip; and wherein each guide vane includes:

a leading edge which comprises a lean angle of about −14°, a bow angle at the vane hub of about 4° and a bow angle at the vane tip of about 10°; and a trailing edge which comprises a lean angle of about −4°, a bow angle at the vane hub of about 12° and a bow angle at the vane tip of about 20°.

38. A cooling fan which comprises:

an outlet guide vane assembly which includes a plurality of radially extending guide vanes, each of which comprises a vane hub, a vane tip and a vane midspan approximately midway between the vane hub and the vane wherein each guide vane comprises a camber of between about 40° and 75° at the vane hub, between about 30° and 65° at the vane midspan and between about 40° and 70° at the vane tip; and wherein each guide vane includes:

a leading edge which comprises a lean angle of about −12°, a bow angle at the vane hub of about 5° and a bow angle at the vane tip of about 12°; and a trailing edge which comprises a lean angle of about 5°, a bow angle at the vane hub of about 14° and a bow angle at the vane tip of about 16°.

* * * * *